US010295310B2

(12) United States Patent
Holtz et al.

(10) Patent No.: US 10,295,310 B2
(45) Date of Patent: May 21, 2019

(54) MODULAR SCALABLE PLATE SYSTEM FOR PERSONNEL PROTECTION

(71) Applicant: The United States of America, as represented by the Secretary of the Navy, Washington, DC (US)

(72) Inventors: Ronald L. Holtz, Lorton, VA (US); Alex E. Moser, Fort Washington, MD (US); James L. Pelland, Fredericksburg, VA (US); Flora M. Jordan, Alexandria, VA (US); James R. Dade, III, Nashville, TN (US); John K. Wilcox, Stafford, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/848,249

(22) Filed: Dec. 20, 2017

(65) Prior Publication Data

US 2018/0100723 A1 Apr. 12, 2018

Related U.S. Application Data

(62) Division of application No. 14/953,306, filed on Nov. 28, 2015, now Pat. No. 9,879,946.

(60) Provisional application No. 62/085,406, filed on Nov. 28, 2014.

(51) Int. Cl.
*F41H 5/04* (2006.01)

(52) U.S. Cl.
CPC ..... *F41H 5/0428* (2013.01); *F41H 5/0471* (2013.01)

(58) Field of Classification Search
CPC ..... F41H 5/0428; F41H 5/0471
USPC ..... 89/36.02, 36.01, 36.05; 428/911
See application file for complete search history.

(56) References Cited

U.S. PATENT DOCUMENTS 4,061,815 A * 12/1977 Poole, Jr. ..... B32B 27/12 428/215
8,746,122 B1 * 6/2014 Roland ..... F41H 5/04 89/36.02
8,981,796 B2 * 3/2015 Soar ..... F41H 1/02 324/654
9,046,324 B2 * 6/2015 Bergman ..... F41H 5/0421
9,046,326 B1 * 6/2015 Rothman ..... F41H 5/0485
2007/0107778 A1 * 5/2007 Bettin ..... A42B 3/121 137/13
2010/0212486 A1 * 8/2010 Kurtz ..... F41H 5/0428 89/36.02
2011/0008598 A1 * 1/2011 Agneloni ..... B32B 3/16 428/213
2011/0232470 A1 * 9/2011 Cioffi ..... F41H 5/0464 89/36.02

(Continued)

*Primary Examiner* — John Cooper
(74) *Attorney, Agent, or Firm* — US Naval Research Laboratory; Richard F. Bis

(57) ABSTRACT

Body armor includes a first armor plate having a concave rear surface, a second plate having a convex front surface. Contours of the second layer are formed by conforming the contours between the polymer plate and the armor plate into a shape that fills gaps or voids between the concave rear surface of the armor plate, such that the armor plate and the polymer plate form a matched set. In operation, the ceramic armor plate can be used alone, the polymer plate can be used alone, or the hard armor layer and the polymer plate can be used together.

8 Claims, 7 Drawing Sheets

(56) References Cited

U.S. PATENT DOCUMENTS

| | | | | |
|---|---|---|---|---|
| 2011/0239851 | A1* | 10/2011 | Mason | B32B 27/04 89/36.02 |
| 2012/0180631 | A1* | 7/2012 | Sporn | F41H 5/0485 89/36.02 |
| 2012/0180636 | A1* | 7/2012 | Seuk | F41H 5/08 89/36.07 |
| 2014/0047972 | A1* | 2/2014 | Carton | F41H 1/04 89/36.02 |
| 2014/0076139 | A1* | 3/2014 | Bergman | F41H 5/0421 89/36.02 |
| 2014/0124561 | A1* | 5/2014 | Neibarger | A45F 3/00 224/625 |
| 2014/0150154 | A1* | 6/2014 | Aquino | F41H 1/02 2/2.5 |
| 2015/0059042 | A1* | 3/2015 | Aquino | F41H 1/02 2/2.5 |

* cited by examiner

MODULAR SCALABLE PLATE SYSTEM FOR PERSONNEL PROTECTION

CROSS-REFERENCE TO RELATED APPLICATIONS

This Application is a divisional under 35 U.S.C. 111(a) of, and claims the benefit of, U.S. patent application Ser. No. 14/953,306 filed on Nov. 28, 2015, which is a non-provisional under 35 USC 119(e) of, and claims the benefit of, U.S. Provisional Application 62/085,406 filed on Nov. 28, 2014, the entire disclosures of which are incorporated herein by reference.

BACKGROUND

1. Technical Field

2. Related Technology

The United States Marine Corp currently fields hard armor plates for personnel protection against battlefield threats. The hard armor plate is the Enhanced Insert Small Arms Protective Insert. The armor plates are inserted in a front or rear pocket of a vest or jacket to protect the individual's vital organs. Additional information about the ESAPI system is found in the Marine Corp Systems Command Product Manager Infantry Combat Equipment Product Sheet, December 2014.

SUMMARY

A body armor system for personnel ballistic protection, substantially as shown in and/or described in connection with at least one of the figures, as set forth more completely in the claims.

These and other advantages, aspects and novel features of the disclosure, as well as details of exemplary embodiments thereof, will be more fully understood from the following description and drawings.

BRIEF DESCRIPTION OF THE DRAWINGS

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

DETAILED DESCRIPTION

1. Introduction

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, and components have not been described in detail to avoid unnecessarily obscuring aspects of the invention.

2. Overview

The present disclosure is directed to a body armor system for protecting personnel against ballistic threats. The modular body armor provides flexibility to battlefield commanders by adapting the body armor to meet the current battlefield threat.

The Department of Justice (DOJ) National Institute of Justice (NIJ) publishes a ballistics resistance standards for specifying and testing ballistic resistant protective materials, based on the equipment standards developed by the Law Enforcement Standards Laboratory of the National Bureau of Standards. As an example, the current NIJ standard for Body Armor-Ballistic Resistance is the NIJ Standard 0101.06 of July 2008. Body armor is classified by the NIJ as one of the following five types of ballistic performance: Type IIA (protects against 9 mm; .40 S&W); Type II (9 mm; .357 Magnum); Type IIIA (.357 SIG; .44 Magnum); 2.4 Type III (Rifles); Type IV (Armor Piercing Rifle); and Special Type. Additional information is found in the U.S. Department of Justice Office of Justice Programs, National Institute of Justice, Ballistic Resistance of Body Armor NIJ Standard 0101.06 July 2008. The Department of Defense identifies different types of threats and tests the armor against specific protocols. Other military ballistic standards, more specific to certain armor such as those described in this document are given in the purchase description associated with the specific armor. An example of this is CO/PD-04-19H, Purchase Description Personal Armor, Enhanced Small Arms Protective Insert, the entirety of which is incorporated by reference herein. Henceforth, the NIJ standard is used for exemplary purposes.

3. Examples

Figure 1A:
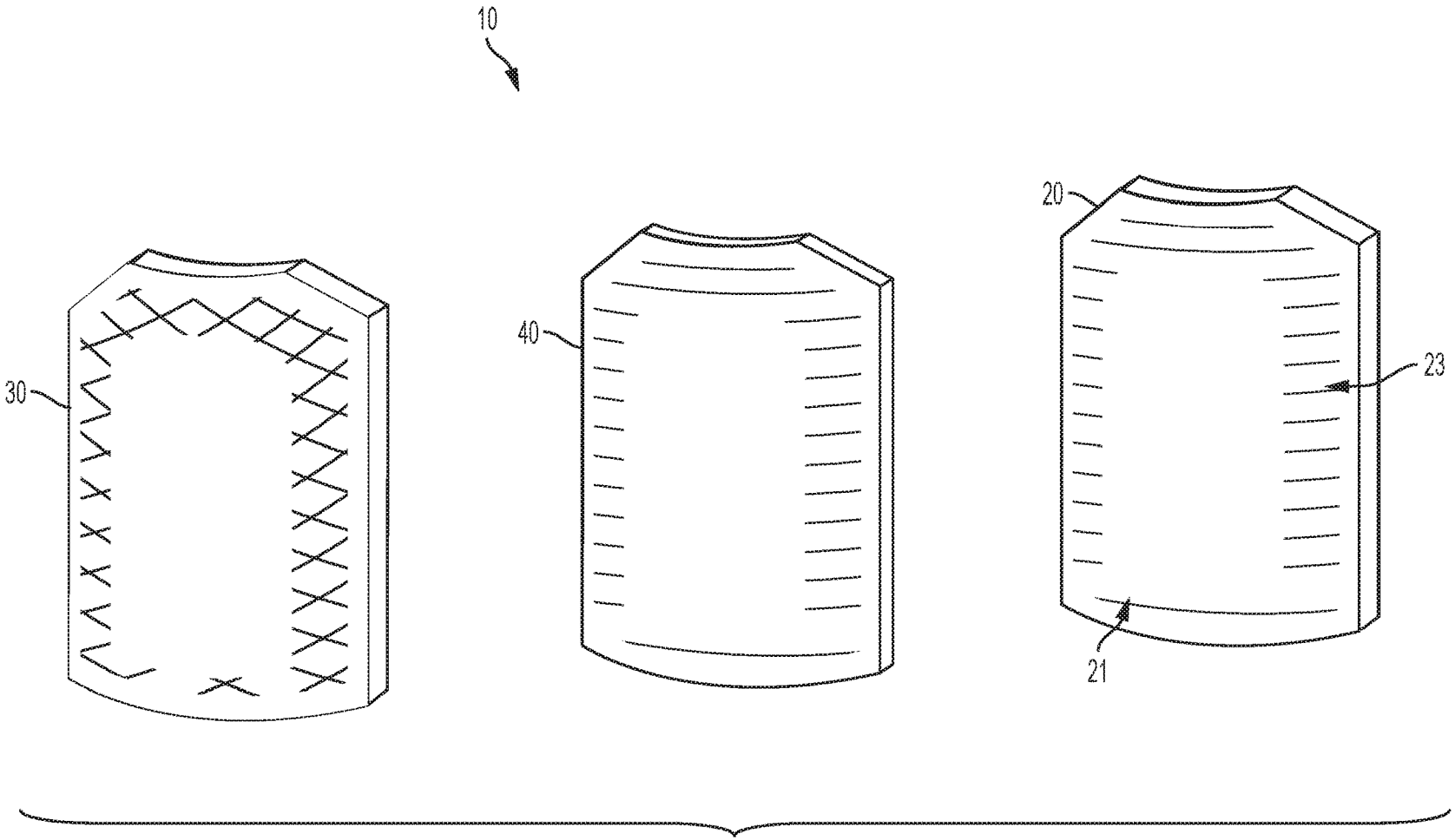
FIG. 1A-1C show a hard armor plate, a polymer plate, and a coupling layer of a body armor system.
Figure 1B:
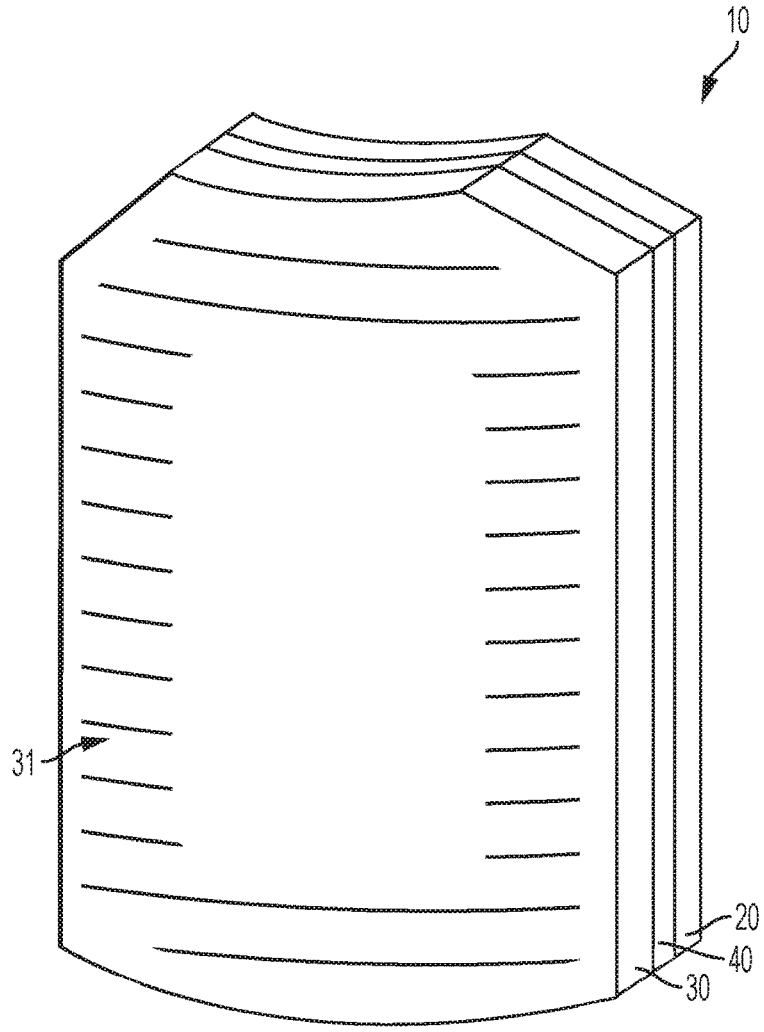
Figure 1C:
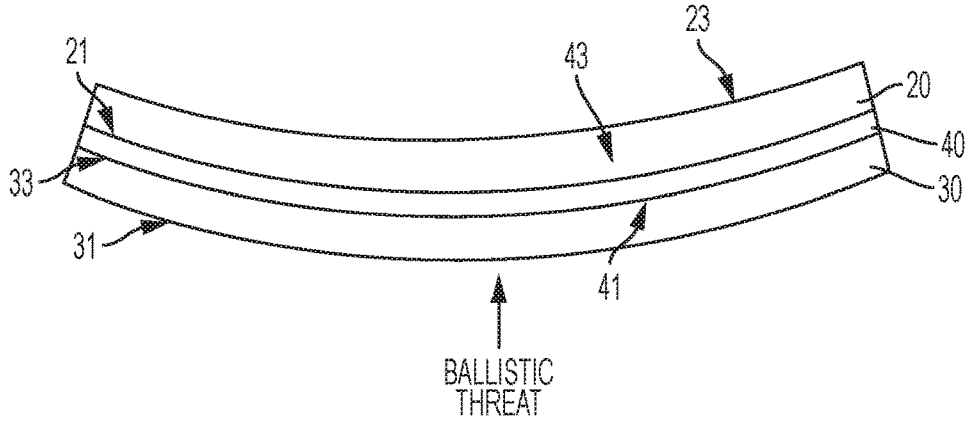

In one example shown in FIG. 1A-1C, an armor system 10 includes several components.

One component is a light and thin polymer plate 20 ("plate A") suitable as the primarily ballistic protection against the prevalent battlefield threats when worn by itself. For example, the thin polymer plate might be worn without additional armor layers when NIJ level III ballistic protection is necessary. The polymer plate 20 can have a convex front surface 21 and a concave rear surface 23.

The modular armor system can be configured to protect the front and rear torso of a wearer with the shape shown in FIG. 1A-1C. The modular armor system can also be configured to protect the sides of the torso, or other parts of the body.

The polymer plate can have the SAPI or ESAPI multi-curve profile in one of the ESAPI standard sizes (extra small, small, medium, large, and extra large), according to drawing numbers Drawing No. 2-6-0588, 2-6-0589, 2-6-0590, 2-6-0591, and 2-6-0592. Other profiles can be suitable, for example, a flat plate, a single curve such as the ESBI according to Drawing No. 2-6-270, double curve, or triple curve profile, plates with profiles different than that of a SAPI or ESAPI plate, such as a swimmer's cut or shooter's cut.

Suitable materials include layers of uniaxially arranged fibers of ultra high molecular weight polyethylene (or UHMWPE) on a polyethylene mat or film, the layers being pressed together and embedded within a resin to form a solid polymer plate. The resulting material has more structural integrity than current "soft armor" materials. Other polymers with similar ballistic protection, weight, and mechanical properties may also be suitable. One source for UHMWPE fiber under the tradename DYNEEMA® is Royal DSM, headquartered in Heerlen, the Netherlands. One suitable DYNEEMA® UHMWPE material is sold under the model number HB-212.

The polymer plate 20 is thinner than the current ESAPI plate, leaving room within the current pocket of a tactical vest or plate carrier for additional armor layers or other material. In one embodiment, the polymer plate is UHMWP and is 0.55 inches thick. Other thicknesses within a range of about 0.3 inches and about 0.6 inches can also be suitable depending on the desired level of protection. In some embodiments, the polymer plate is 0.35 inches or 0.45 inches thick.

Another component is a hard armor plate 30 ("plate B") positioned in front of the polymer plate for additional protection in high threat environments in which a higher degree of ballistic protection is desired, e.g., NIJ level IV protection. The hard armor plate 30 can be a ceramic material, such as, for example, silicon carbide, boron carbide, or a mixture of these. Other ceramics can also be suitable, such as, for example, aluminum oxide, titanium boride, aluminum nitride, and synthetic diamond composite. It can also be a composite comprising one or more of metal, polymer, or refractory material, including bulk metallic glass, metal matrix composites, metal polymer composites, or refractory polymer composites. The hard armor plate can have a hardness in a range of about 4 Mohs to about 9 Mohs.

The hard armor plate 30 can have a convex front surface 31 and a concave rear surface 33. The shape of the hard armor plate can have the SAPI or ESAPI multi-curve profile in one of the ESAPI standard sizes (extra small, small, medium, large, and extra large), according to drawing numbers Drawing No. 2-6-0588, 2-6-0589, 2-6-0590, 2-6-0591, and 2-6-0592. Other profiles can be suitable, for example, a flat plate, a single curve such as the ESBI according to Drawing No. 2-6-270, double curve, or triple curve profile, plates with profiles different than that of a SAPI or ESAPI plate, such as a swimmer's cut or shooter's cut.

Figure 2:
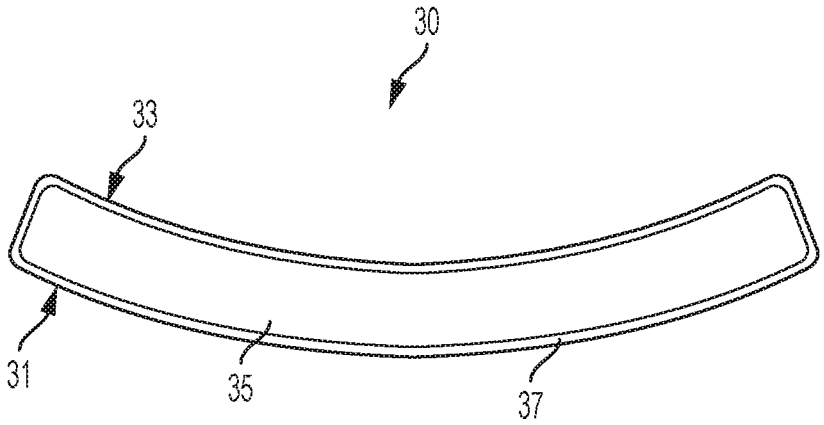
FIG. 2 is a cross sectional view of the body armor system.

In some embodiments, and as shown in FIG. 2, the hard armor plate 30 includes a ceramic core 35 with a layer of a crack arrestor 37. The crack arrestor can be a thin layer of material bonded or adhered to the ceramic material on one or both faces. The material can be a carbon fiber composite fabric, metal, or a polymer, any one of these in a weave, unidirectional fiber or composite matte configuration. The hard armor plate component 30 can optionally include a thin backing material, such as polyethylene (not shown).

The ceramic core of the hard armor plate can be in the range of about 0.25 inches thick to about 0.4 inches thick, and in one embodiment, is 0.35 inches thick.

Because of the manufacturing tolerances of the hard armor plate 30 and the polymer plate 20, their facing surfaces 21 and 33 may have voids or gaps in some regions that can cause significant ballistic performance reduction.

A third component of the armor system is a coupling layer 40 positioned between the armor plate and the polymer plate. The coupling layer has a contour on one face that matches the concave contour of the rear face 33 of the hard armor plate 30 and has a contour on its opposite face that matches the convex contour of the front face 21 of the polymer plate 20. When positioned between the polymer plate and the hard armor plate, the coupling layer 40 fills the space between the first plate and the hard armor plate to minimize or eliminate gaps or voids. The coupling layer can be thinner than the first plate and the hard armor plate, with some very thin areas where the gap is smaller, and some thicker portions where the gap between the armor layers is wider.

In an exemplary embodiment, the coupling layer 40 is formed of a compliant material that assumes the contours of the polymer plate and the hard armor plate. For example, the coupling layer can be an epoxy, a low-durometer silicone, a silicone polymer or dilatant material, or foams of any of these materials. For some polymers and dilatant materials that are not heat-tolerant on their own, a binding material such as ceramic or glass can be included to increase the operational temperature range of the coupling layer.

The coupling layer 40 can be formed of an epoxy filled with glass or ceramic particles. The particles can be nano- or micro-spheres in any combination of solid spheres, hollow spheres, partially evacuated hollow spheres, and hollow spheres filled with a solid, liquid, gas, or mixture thereof. The nano-spheres or micro-spheres may be of the same size or, optimally, have a size distribution.

To form the coupling layer, a release agent or film can be applied to the one of the plates (e.g., plate A or plate B), and the uncured coupling material and any particles (e.g., glass or ceramic particles) are added. Another release agent or film is added on the other plate (plate B or plate A) and the stack is pressed into position such that the epoxy layer conforms to the contours of both plates. The coupling layer material is allowed to take on its final shape by hardening, curing, or drying, after which the plates are removed, releasing both faces of the coupling layer. In another embodiment, release agent is only applied to the hard front armor component to enable the coupling material to be permanently affixed to the back plate.

Because the coupling layer 40 has front and rear surfaces 41 and 43 that match the contours of the particular plates between which the coupling layer was formed, the coupling layer, the polymer plate and the hard armor plate form a matched set that is optimally used together as an armor system.

In an exemplary embodiment, the coupling layer, the polymer plate and the hard armor plate layers together have the dimensions and contours specified for the ESAPI armor systems intended to protect a wearer's front and rear torso. The combined weight of the first plate, second plate, and coupling layer can be less than or equal to the weight of current ESAPI plates. The combined thickness of the first plate, second plate, and coupling layer fitted together can be less than or equal to the thickness of the current ESAPI plates.

Elements of the armor system can also be configured to protect a wearer's side torso or other body parts. For side torso protection, the coupling layer, the polymer plate and the hard armor plate layers together have the dimensions and contours specified for the ESAPI Enhanced Side Torso Plates (ESBI) armor systems. The combined weight and thickness of the first plate, second plate, and coupling layer can be less than or equal to that of current ESBI plates.

In some environments in which the predominant threat is considered to be ball type small arms, the user can wear either plate A 20 or plate B 30, but is not required to wear both, for adequate ballistic protection. In environments in which the threat includes more aggressive threats (e.g., NIJ level IV), Plate A and Plate B can be worn together (with the coupling layer between them) to provide additional protection.

Figure 3A:
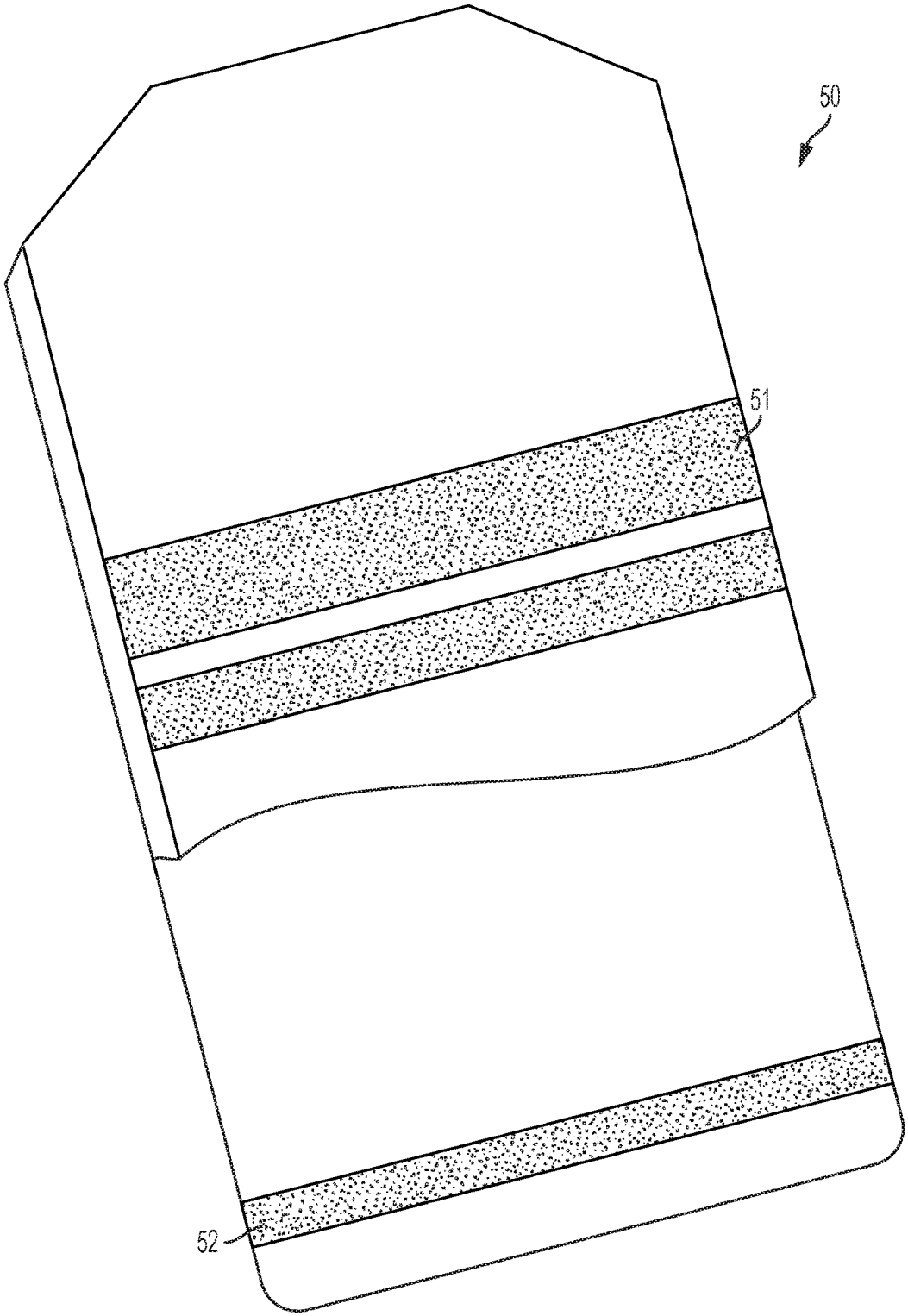
FIG. 3A illustrates a pocket for carrying the body armor system.
Figure 3B:
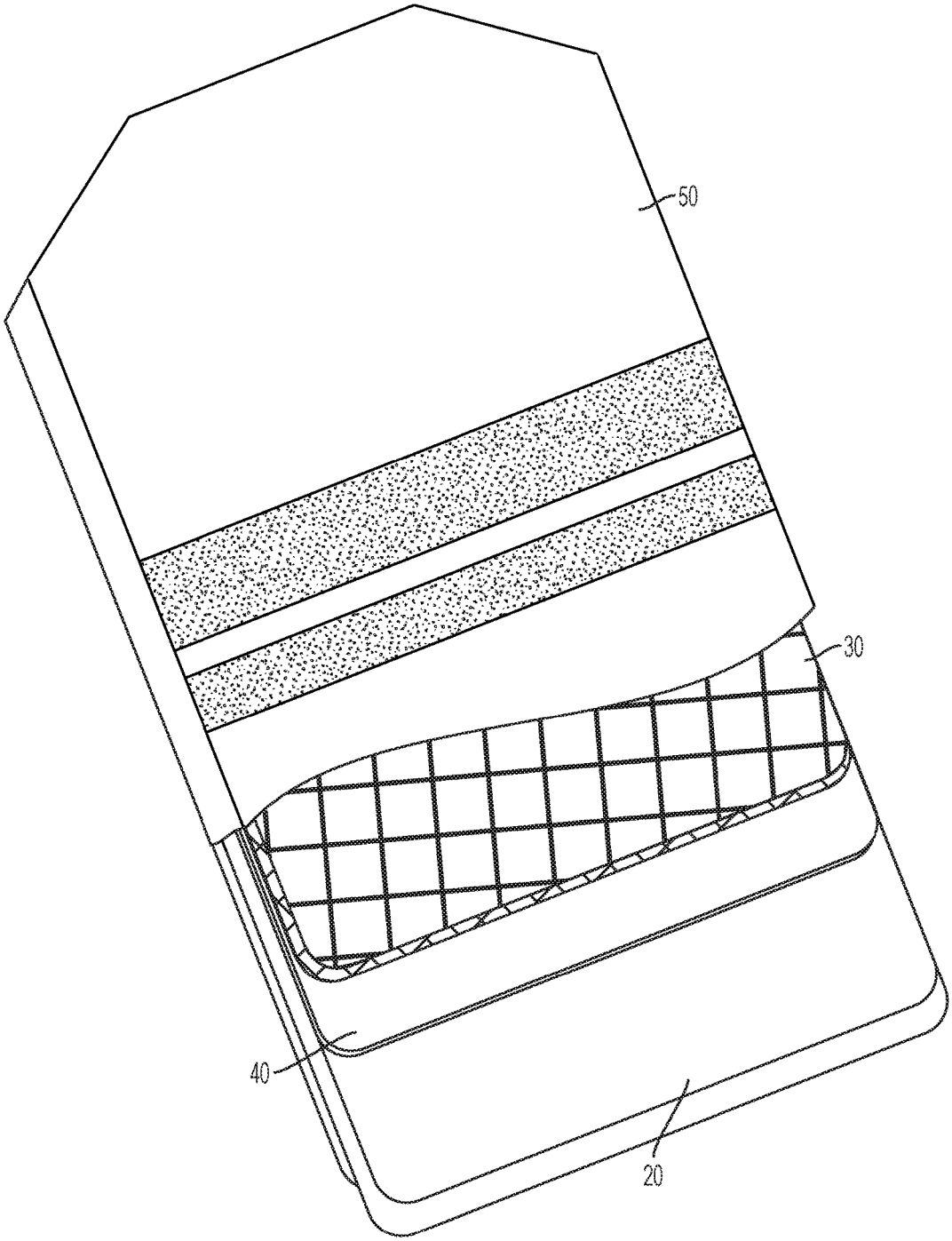
FIG. 3B illustrates the body armor system partially within the pocket.

In an exemplary embodiment, the first plate 20, armor plate 30, and coupling layer 40 are sized to be held together and to fit within an enclosure such as a tactical vest pocket or plate carrier. An exemplary pocket 50 is shown in FIG. 3A. FIG. 3B shows the pocket 50 with the armor components partially inserted into the pocket. The hard armor plate 30 is positioned in front of the coupling layer 40 and the polymer plate 20. Hook and loop closure strips 51, 52, or other suitable closures, can releasably close an end of the pocket.

The armor system 10 is preferably used in a tactical vest pocket or plate carrier that includes a soft armor component that is positioned behind the armor system (between the armor system and the wearer's body). The soft armor can be, for example, many layers or plies of woven or laminated fabric formed of very strong bullet-resistant fibers, such as UHMWPE or polyaramid fiber (e.g., those sold under the tradenames DYNEEMA or SPECTRA SHIELD, and TWARON or KEVLAR, respectively). The soft armor can include between about 10 and about 50 layers, depending on the thickness of the layers. A typical level IIIA soft armor insert can include 34 layers of KEVLAR® polyaramid fabric.

The armor system 10 can optionally also include one or more spacers dimensioned to fill the resulting empty space in the pocket or plate carrier when the first plate or the armor plate are not in use. The spacers can have the same approximate dimensions as the polymer plate 20 and the armor plate 30, respectively. The spacers are preferably very lightweight. In some embodiments, a spacer can be formed of a material that adds buoyancy to the armor system, such as, for example, a light-weight closed-cell foam. The spacers can be rigid, or alternatively can be somewhat flexible and compressible for more comfort.

In some embodiments, each of the armor components 20, 30, and 40 includes hook and loop fabric closure, or other connectors, for holding the selected armor components in direct contact with each other during operational use.

In other embodiments, the components are not mechanically constrained by closures but are instead simply held in position tightly within a pocket integral to the tactical vest or plate carrier or a pocket sewn within the tactical vest or plate carrier.

In other embodiments, the armor components are enclosed within an insert pocket that is releasably attached to the tactical vest or plate carrier.

The armor system 10 can be configured to be used in the Soldier Plate Carrier System, the Modular Tactical Vest, the Improved Outer Tactical Vest, or other protective clothing.

In some embodiments, the coupling layer is a separate layer that is not attached to either the polymer plate or the hard armor plate.

Figure 4A:
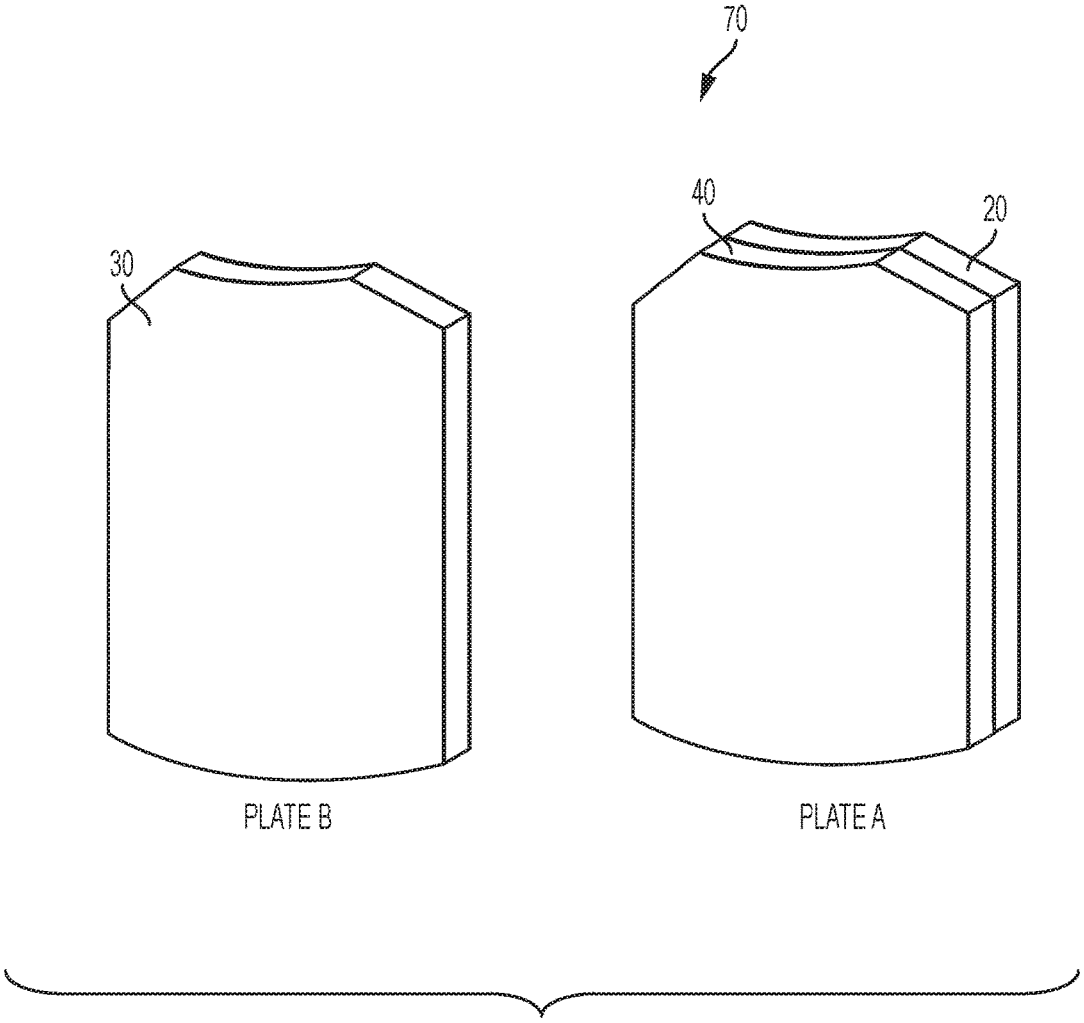
FIG. 4A-4C show a body armor system with a hard armor plate and a polymer plate with a coupling layer affixed to the front of the polymer plate.
Figure 4B:
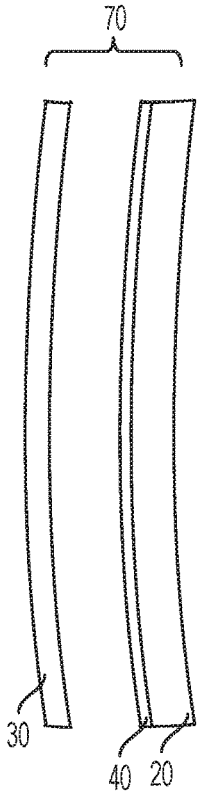
Figure 4C:
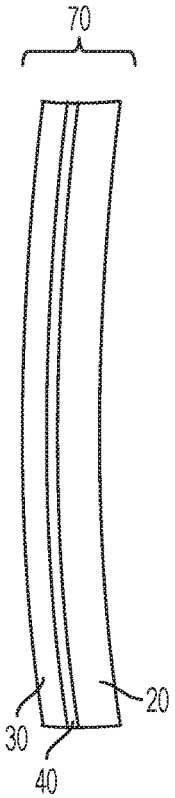

In other embodiments, the coupling layer is affixed to the polymer plate when the coupling layer is formed, and remains affixed to the polymer plate. FIG. 4A illustrates the armor system 70 having a plate A that includes both the polymer plate 20 and the coupling layer 40, and a hard armor plate 30 (plate B). As discussed above, it is envisioned that the coupling layer 40 can adhere itself to the front surface of the solid polymer plate 20 when an uncured coupling layer material in a liquid or uncured resin state is pressed between the polymer plate 20 and the armor plate 30. However, in some embodiments, an adhesive can be used to join the coupling layer to the front surface of the polymer plate. FIG. 4B shows the armor system in cross section, with the plates A and B separated, and FIG. 4C shows the armor system in cross section with the plates in contact.

Figure 5:
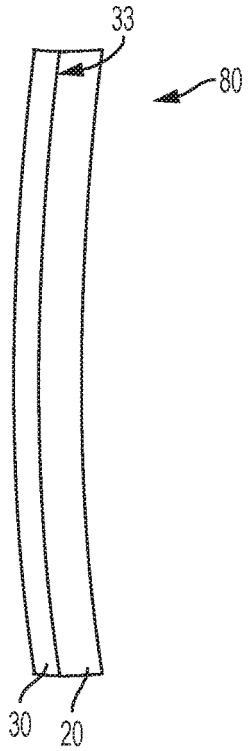
FIG. 5 is a cross sectional view of a body armor system with a hard armor plate and a polymer plate, the plates having matching contours on their facing surfaces.

In other embodiments illustrated in FIG. 5, an armor system 80 includes only the polymer plate 20 and the hard armor plate 30, without a coupling layer. The polymer plate 20 and the hard armor plate 30 are configured to fit tightly together so they are in direct contact while being worn. The manufacturing processes of the armor plate 30 and the polymer plate 20 can result in plates whose surfaces do not conform well to each other, with gaps that can vary from 0 inches in some locations to about ¼ inch in other locations. To remedy this, the polymer plate can be conformed to the armor plate by heat and/or pressure so the front of the polymer plate is in contact with the rear surface 33 of the hard armor plate 30 over the entire surface area of the plates. This process removes any gaps or voids that occur due to the manufacturing of individual plates. The polymer plate 20 (plate A) and the hard armor plate (plate B) form a matched set that are used together due to their matching contours. As in the embodiments described above, the plates can be used individually or together, depending on the threat environment. The profile and dimensions of the plates can be the SAPI, ESAPI, swimmers's cut, or shooter's cut, or another profile.

4. Conclusion

Survivability is determined from a combination of factors including ballistic protection level and warfighter mobility. The armor embodiments described herein are believed to provide a significant improvement over current armor systems in several aspects. Current armor, capable of stopping most of the advanced threats on the battle field (NIJ level IV), weighs over 31 lbs.

In contrast, the armor systems described herein can provide several different ballistic protection levels. Armor capable of stopping the current prevalent battlefield threats (e.g., NIJ level III), those seen exclusively in the operating theater approximately 90% of the time, would only weigh approximately 21 lbs. If the soldier was required to wear only the NIJ level III armor (e.g., plate A) during operations in which intelligence indicated only NIJ level III threat existed, the soldier would be more mobile. In the other 10% of the cases, in which intelligence indicated advanced threats existed, the soldier would be required to add an advanced threat level armor (e.g., Plate B) in conjunction with the NIJ III armor. Thus, the ballistic protection would be adequate 100% of the time, matched to the battlefield threat, but the soldier would be lighter 90% of the time. This allows soldier mobility to be significantly increased without compromising ballistic protection.

The Detailed Description of the Exemplary Embodiments has revealed the general nature of the present disclosure that others can, by applying knowledge of those skilled in relevant art(s), readily modify and/or adapt for various applications such exemplary embodiments, without undue experimentation, without departing from the spirit and scope of the disclosure. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

What is claimed as new and desired to be protected by Letters Patent of the United States is:

1. A body armor system, comprising:

a first plate having a concave rear surface;

a second plate having a convex front surface with a contour that matches a contour of the concave rear surface of the first plate, such that when worn, the front of the second plate is in contact with the rear surface of the first plate over the entire surface area of the plates;

the contour of the convex front surface of the second plate being formed by conforming the second plate to the concave rear surface of the first plate to fill gaps and voids such that the first plate and the second plate are releasably fitted together to form a matched set.

2. The body armor system of claim 1, wherein the first plate is harder than the second plate.

3. The body armor system of claim 1, further comprising: a fabric pocket, wherein the first plate and the second plate fit snugly in the pocket.

4. The body armor system of claim 1, wherein the first plate comprises a ceramic.

5. The body armor system of claim 1, wherein the ceramic comprises at least one of boron carbide or silicon carbide.

6. The body armor system of claim 1, wherein the first plate comprises a hard or refractory core with a crack mitigation layer adhered to the hard or refractory core on at least one of the front surface and the concave rear surface of the hard or refractory core.

7. The body armor system of claim 1, wherein the second plate comprises an ultra high molecular weight polyethylene.

8. The body armor system of claim 7, wherein the second plate comprises a plurality of layers of ultrahigh molecular weight polyethylene fiber embedded in a resin to form a solid plate.

* * * * *